US010718161B2

(12) United States Patent
Bernhardsson et al.

(10) Patent No.: US 10,718,161 B2
(45) Date of Patent: Jul. 21, 2020

(54) RUNG FOR A COLLAPSIBLE LADDER

(71) Applicant: Telesteps AB, Tranås (SE)

(72) Inventors: Jens Bernhardsson, Limhamn (SE); Stina Karlsson, Limhamn (SE); Henrik Edvardsson, Malmö (SE); Niklas Ekstrand, Lund (SE); Carl-Johan Nelson, Bjärred (SE); Ulrik Gejervall, Forserum (SE)

(73) Assignee: Telesteps AB, Tranås (SE)

( * ) Notice: Subject to any disclaimer, the term of this patent is extended or adjusted under 35 U.S.C. 154(b) by 0 days.

(21) Appl. No.: 16/090,907

(22) PCT Filed: Apr. 4, 2017

(86) PCT No.: PCT/EP2017/058027
§ 371 (c)(1),
(2) Date: Oct. 3, 2018

(87) PCT Pub. No.: WO2017/174602
PCT Pub. Date: Oct. 12, 2017

(65) Prior Publication Data

US 2019/0128064 A1 May 2, 2019

(30) Foreign Application Priority Data

Apr. 4, 2016 (SE) ..... 1650454

(51) Int. Cl.
*E06C 7/08* (2006.01)
*E06C 1/12* (2006.01)
(Continued)

(52) U.S. Cl.
CPC ..... *E06C 7/083* (2013.01); *E06C 1/125* (2013.01); *E06C 1/18* (2013.01); *E06C 1/22* (2013.01);
(Continued)

(58) Field of Classification Search
CPC . E06C 7/083; E06C 7/00; E06C 7/003; E06C 7/08; E06C 7/081; E06C 7/14;
(Continued)

(56) References Cited

U.S. PATENT DOCUMENTS 1,576,625 A * 3/1926 Blodgett ..... E06C 1/125 182/166
2,194,856 A * 3/1940 Kostuk ..... E06C 1/22 182/126
(Continued)

FOREIGN PATENT DOCUMENTS

CN 101294479 A 10/2008
CN 102465662 A 5/2012
(Continued)

*Primary Examiner* — Katherine W Mitchell
*Assistant Examiner* — Candace L Bradford
(74) *Attorney, Agent, or Firm* — Capitol City TechLaw

(57) ABSTRACT

A rung for use in a ladder section of a collapsible ladder (1) is provided. The collapsible ladder comprises several ladder sections (5, 5*a*-5*j*), where each ladder section comprises two ladder tubes (10, 12) arranged parallel to each other and interconnected by the rung (20) to form the respective ladder section, and where each ladder tube (10, 12) is telescopically inserted into a ladder tube (10, 12) of a lower ladder section to form the collapsible ladder (1), the rung (20) comprising a main section (22), a first bracket section (24*a*) and a second bracket section (24*b*), wherein the first and second bracket sections (24*a*, 24*b*) are arranged at each end of the rung (20) to receive the respective ladder tube (10, 12). The rung (20) is characterized in that the main section (22) and the first and second bracket sections (24*a*, 24*b*) are provided as an integrated unit.

9 Claims, 7 Drawing Sheets

(51) Int. Cl.

| | |
|---|---|
| ***E06C 7/00*** | (2006.01) |
| ***E06C 1/22*** | (2006.01) |
| ***E06C 7/14*** | (2006.01) |
| ***E06C 1/18*** | (2006.01) |

(52) U.S. Cl.
CPC ..... *E06C 7/00* (2013.01); *E06C 7/003* (2013.01); *E06C 7/08* (2013.01); *E06C 7/081* (2013.01); *E06C 7/14* (2013.01)

(58) Field of Classification Search
CPC ... E06C 1/125; E06C 1/18; E06C 1/22; A41D 13/08
See application file for complete search history.

(56) References Cited

U.S. PATENT DOCUMENTS 3,487,889 A * 1/1970 Carlin ..... E06C 7/08 182/46
4,520,896 A * 6/1985 Disston ..... E06C 1/22 182/156
8,225,906 B2 * 7/2012 Kieffer ..... E06C 1/125 182/195
2002/0189902 A1 * 12/2002 Nelson ..... E06C 7/00 182/129
2006/0283664 A1 * 12/2006 Yao ..... E06C 7/06 182/156
2007/0256892 A1 * 11/2007 Breedlove, Sr. ..... A01M 31/02 182/116
2008/0011547 A1 * 1/2008 Bonitto ..... E06C 7/00 182/129
2012/0267195 A1 * 10/2012 Bachorski ..... A45F 5/102 182/129
2014/0027203 A1 * 1/2014 Whitcomb ..... A45F 5/1046 182/129
2018/0171713 A1 * 6/2018 Eienbeck ..... E06C 7/00

FOREIGN PATENT DOCUMENTS

| | | | |
|---|---|---|---|
| DE | 102014107182 | A1 | 12/2014 |
| EP | 2113631 | A1 | 11/2009 |
| GB | 2233022 | A | 1/1991 |
| GB | 2305956 | A | 4/1997 |

* cited by examiner

RUNG FOR A COLLAPSIBLE LADDER

This application claims priority under 35 USC 119(a)-(d) to SE patent application No. 1650454-0, which was filed on Apr. 4, 2016, the entire contents of which are incorporated herein by reference.

TECHNICAL FIELD

The present invention relates to a rung for use in a ladder section of a collapsible ladder which comprises several ladder sections, where each ladder section comprises two ladder tubes arranged parallel to each other and interconnected by a rung to form the ladder section. Each ladder tube is telescopically inserted into a ladder tube of a lower ladder section to form the collapsible ladder. The present invention also relates to an improved telescopic or collapsible ladder or a stepladder.

BACKGROUND

As well known by persons skilled in the art of collapsible ladders, such ladders usually comprise a number of tube portions having various diameters and which hence are telescopically insertable into one another. Every upper end of any of the tube portions are fastened to one end of a ladder step, whereas the other end of the ladder step is fastened to an upper end of a tube portion having the same diameter, the two tube portions and the ladder step forming a ladder section, the tube sections of which being insertable into an adjacent ladder section comprising tube portions having a larger diameter.

The resulting ladder can hence be collapsed by inserting higher ladder sections into lower ladder sections, and the ladder can be extended by extracting higher ladder sections from the lower ladder sections. A pin extending through the holes in the outer walls of two adjacent tube portions locks the tube portions to prevent the extended ladder from collapsing. Ladders having collapsible and expandable ladder sections are used in order to make the ladder smaller for storage and transport purposes.

The manufacturing process of a rung and the collapsible ladder to which will be attached involves several steps. Due to the construction of the rungs in prior art, the manufacturing and assembly process is complex. Furthermore, the durability of the collapsible ladder is always a quality that needs to be improved.

It is the object of the present invention to provide a rung and a collapsible ladder where the construction is simplified and the ladder is more durable.

SUMMARY OF INVENTION

An object of the present invention is to provide a rung for a collapsible ladder which simplifies the assembly of the collapsible ladder while simultaneously making the ladder more durable.

According to a first aspect, a rung for use in a ladder section of a collapsible ladder is provided. The collapsible ladder comprises several ladder sections, where each ladder section comprises two ladder tubes arranged parallel to each other and interconnected by a rung to form the respective ladder section. Each ladder tube is telescopically inserted into a ladder tube of a lower ladder section to form the collapsible ladder. The rung comprises a main section, a first bracket section and a second bracket section, wherein the first and second bracket sections are arranged at each end of the rung to receive the respective ladder tube. The rung is characterized in that the main section and the first and second bracket sections are provided as an integrated unit.

The feature of the rung being formed as an integrated unit provides several benefits to the construction of the collapsible ladder. For example, since the new improved ladder consists of fewer separate parts the assembly of the collapsible ladder is simplified. The production time is thus decreased leading to lower productions cost.

Furthermore, in prior art system the first and second bracket sections were attached to the main section of the rung using for example by means of press fit. This step of attachment generally causes problem when performing quality tensile tests, since the parts may disconnect from each other. By providing the rung as an integrated unit this problem is diminished. The durability of an integrated rung is increased, especially when quality testing the ladder using tensile tests.

The main section and the first and second bracket sections may be formed by the same material.

The first and second bracket sections may be symmetrical to each other.

The main section may be inclined at an angle to a plane in which said first and second bracket sections extend.

At least a part of the main section may be provided with an outer layer comprising a plurality of depressions or protrusions.

At least a part of the main section may comprise a plurality of depressions or protrusions.

The rung may comprise at least one grip handle. The at least one grip handle may be arranged at a distance d from a central line of the rung, wherein the central line is parallel with the ladder tubes and wherein the central line is perpendicular to a longitudinal line.

The grip handle and the rung may be provided as an integrated unit. The grip handle may be arranged on a bottom plate, wherein the bottom plate is removable arranged to the main section of the rung.

The rung may comprise a locking mechanism. The rung may comprise at least one locking indicator to enable the visualization of whether the locking mechanism is in a locked position or not.

According to a second aspect, a collapsible ladder is provided. The collapsible ladder comprises several ladder sections, each ladder section comprises two ladder tubes arranged parallel to each other and interconnected by a rung to form the respective ladder section, and where each ladder tube is telescopically inserted into a ladder tube of a lower ladder section to form the collapsible ladder. The rung comprises a main section, a first bracket section and a second bracket section, wherein the first and second bracket sections are arranged at each end of the rung to receive the respective ladder tube. The collapsible ladder is characterized the main section of the rung, the first bracket section and the second bracket section are provided as an integrated unit.

According to a third aspect, a collapsible stepladder is provided. The collapsible stepladder comprises a first and a second ladder leg, where the legs are hingedly connected to each other in one end, and where each of the ladder legs comprises several ladder sections. Each section comprises two ladder tubes arranged parallelly to each other and interconnected by a rung to form the respective ladder section. Each ladder tube is telescopically inserted into a ladder of a lower ladder section to form the collapsible stepladder comprising at least three ladder sections. The rung comprises a main section, a first bracket section and a second bracket section, wherein the first and second bracket sections are arranged at each end of the rung to receive the respective ladder tube. The collapsible stepladder is characterized the main section of the rung, the first bracket section and the second bracket section are provided as an integrated unit.

BRIEF DESCRIPTION OF THE DRAWINGS

In the following, the invention will be explained with reference to the accompanying drawings, where.

DETAILED DESCRIPTION OF EMBODIMENTS

Figure 1A:
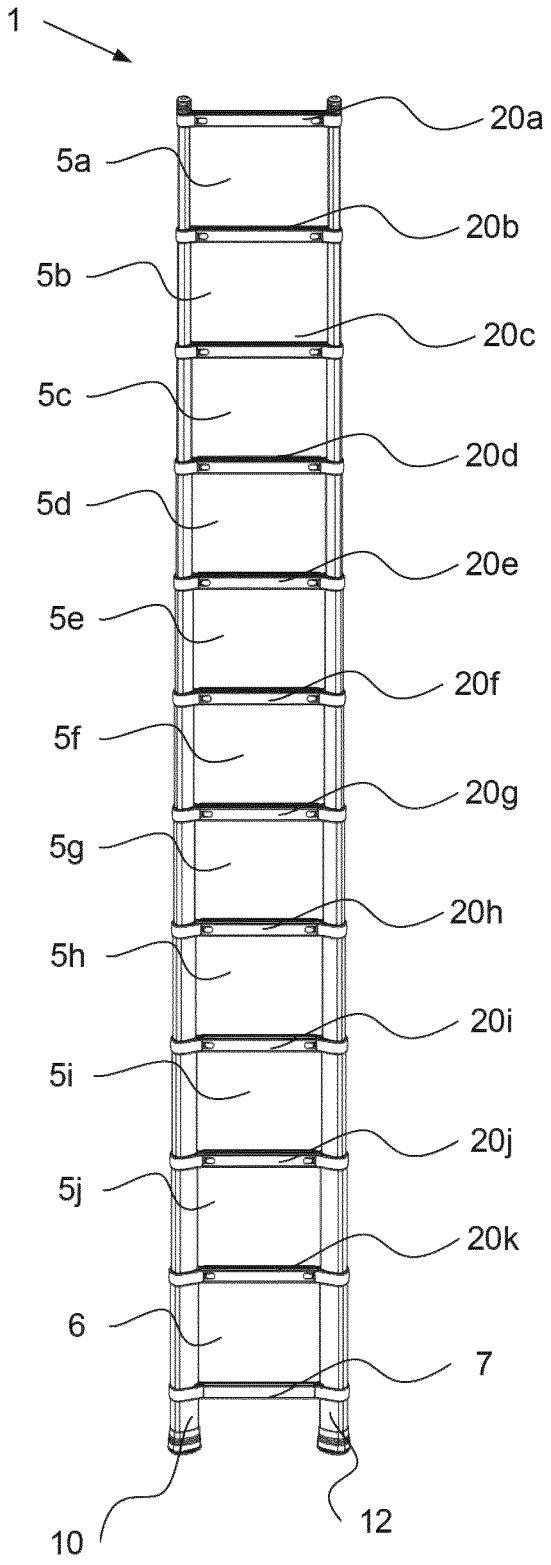
FIG. 1*a* is a front view of an extended ladder according to an embodiment.

In FIG. 1 a collapsible ladder 1 is shown in a fully extended state. The collapsible ladder 1 comprises several ladder sections 5*a-j* where each ladder section 5*a-j* comprises two ladder tubes 10, 12 and one rung 20*a-k*. The ladder sections are in a U-shaped form where the two ladder tubes 10, 12 are arranged parallel to each other and are interconnected at one end by one rung 20*a-k*. The rungs 20*a-k* are arranged horizontally between the vertically arranged ladder tubes 10, 12. The ladder tubes 10, 12 are divided into sections 5*a-j*, which telescope into each other. A section arranged higher than another lower section (for example section 5*a* is arranged higher than section 5*b*) has an outer diameter which is smaller than the inner diameter of the lower section. This allows the higher section to telescope inside the tube section between an extended state and a collapsed state.

Figure 1B:
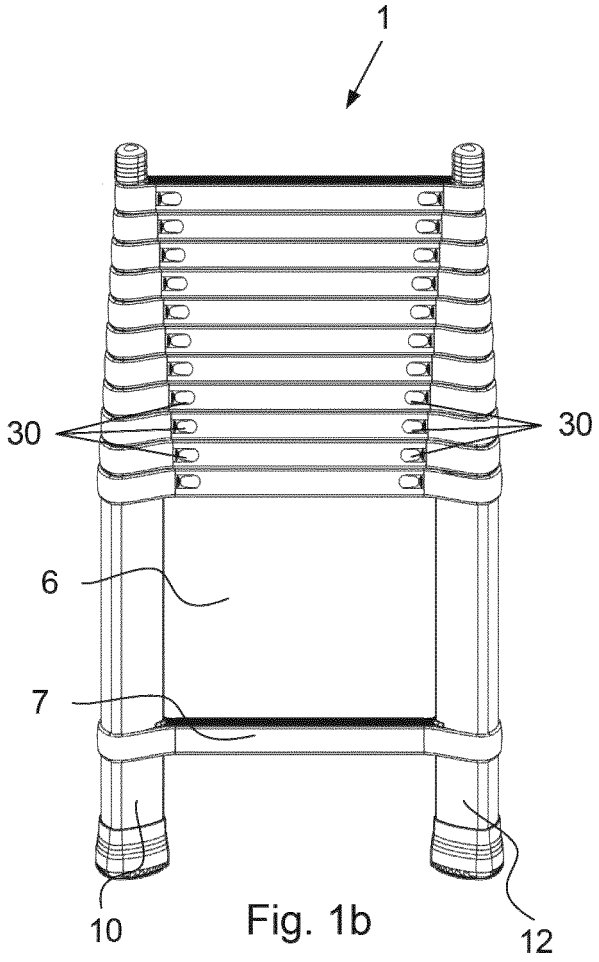
FIG. 1*b* is a front view of a maximally collapsed ladder according to an embodiment.

A maximally collapsed ladder is shown in FIG. 1*b*. The lowermost ladder section 6 comprises a stationary rung 7 which is provided at the bottom of the ladder, designed to provide an extra foot support and a more stable lowermost ladder section 6. A seen in FIG. 1*b*, the lowermost ladder section 6 is stationary and cannot be telescoped into the other sections 5*a-j*. The lowermost ladder section 6 may comprise two rungs, the stationary rung 7 and the rung 20*k*.

The ladder tubes 10, 12 may be provided with end portions on which the ladder stands. The end portions are thus arranged at the lowest part of the ladder tubes 10, 12. The end portions may be arranged with a material of high friction, thus lowering the risk of the ladder moving during use.

In order to telescopically collapse and expand the ladder, a locking or retaining mechanism may be provided. In the embodiment shown in FIGS. 1*a-b* a retaining mechanism comprises a plurality of actuators 30 arranged on each individual rung 20*a-k* in order to release the respective sections 5. The retaining mechanism comprise a spring-loaded locking pin 27 (see FIG. 5*a-c*) which locks a ladder section 5*a* in relation to another adjacent ladder section 5*b* by being inserted into locking holes 17 in the ladder tube (see FIG. 3*d*). Each section 5*a-j* is individually released by using actuators 30 (such as rotary buttons or slide buttons) arranged on both sides of the rung 20. By using the actuators 30, for example sliding slide buttons towards each other, the locking pins 27 are withdrawn from the respective locking holes 17 in the ladder tube 10, 12. Such a retaining mechanism is described in the European patent EP120021203, which is hereby incorporated by reference.

In one embodiment the ladder only comprises one pair of actuators which for example are arranged on the front side of the second lowermost rung. The single pair of actuators will still be able to collapse the entire ladder. Alternatively, the ladder comprises a first pair of actuators arranged on the second uppermost ladder rung and a second pair of actuators arranged on a rung positioned between the second uppermost rung and the second lowermost rung. The second pair of actuators enables the lowering of a lower part of a collapsible ladder and the first pair of actuators enables the lowering of an upper part of the collapsible ladder. Such actuators are described in the European patent EP1728966, which is hereby incorporated by reference.

In a further embodiment the pin of the lowest ladder section may be withdrawn from interaction with its respective holes in the tubes of the neighboring ladder section by manipulating a foot control located and arranged to maneuvered by a foot of a user of the ladder. Such a locking mechanism is described in the international application WO20120020333, which is hereby incorporated by reference.

It should be noted that although only some types of locking/retaining mechanisms are mentioned herein, any type of mechanism suitable to collapse and expand a telescopic ladder could be used.

Figure 2A:
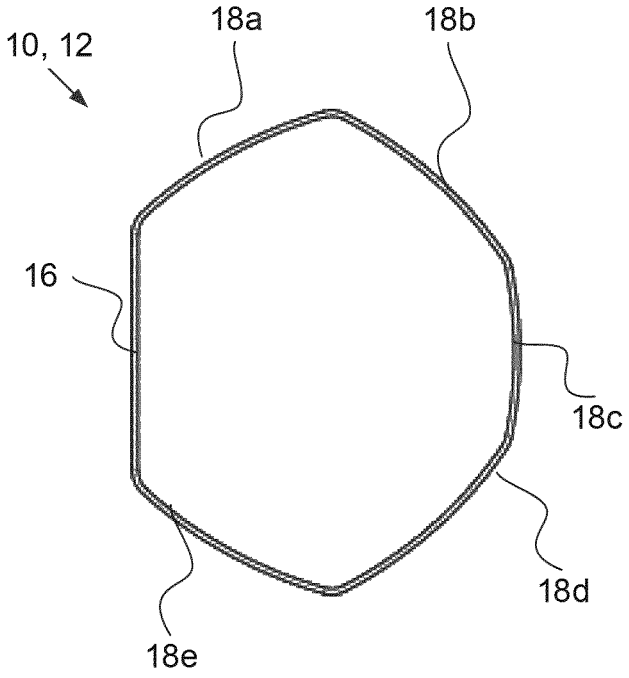
FIG. 2*a-c* each shows a cross section view of a ladder tube according to different embodiments.
Figure 2B:
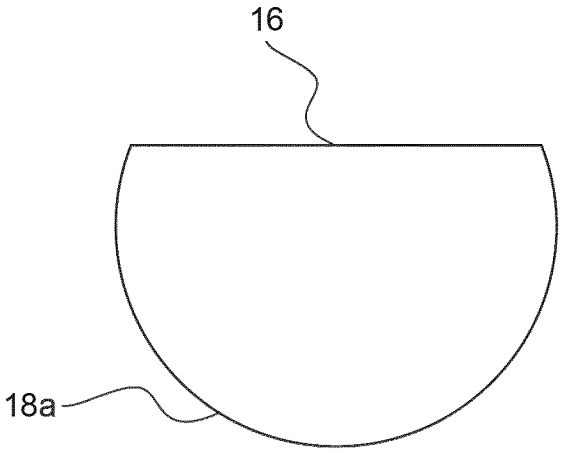
Figure 2C:
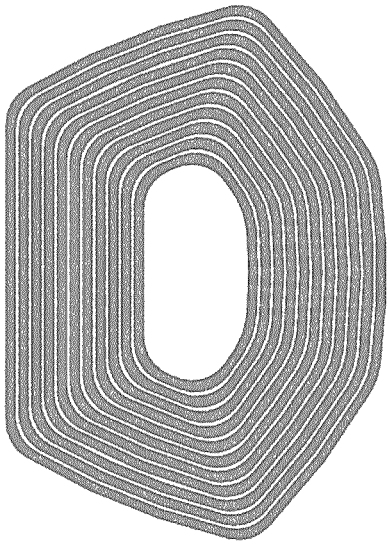

Different embodiments of a cross-sectional shape of a ladder tube are shown in FIGS. 2*a-c*. The cross-sectional shape comprises at least one straight section 16 and at least one additional section 18. The cross-sectional shape may have any number of additional sections 18. The number of additional sections may be one, two, three, four, five, six and so on. The section or sections may comprise one side. The additional section/sections may be straight, concave, convex or otherwise rounded. Furthermore, the cross section may be symmetrical or asymmetrical.

It is beneficial if the cross-sectional shape has a relatively small cross section area to decrease the material costs. At the same time it is beneficial to have a shape which has a high resistance to bending. The section modulus is highly dependent on the cross sectional shape.

Furthermore the ladder tube 10, 12 should have a form which allows for an easy manufacturing process. The manufacturing process involves several crucial steps, for example extruding the profile which the ladder tube 10, 12 may be constructed from, measuring where the locking holes should be placed and actually perform the manufacturing of the holes. Having a tube 10, 12 with a cross section comprising a straight side 16 improves the quality of the performance of these steps.

The ladder tube 10, 12 may be formed as an extruded aluminum profile. If high temperature extrusion is used for this process, the risk of deformation after the extrusion process is reduced if the tube 10, 12 has a straight section which it can rest while cooling down.

Having a straight section 16 is also beneficial as a reference point during the manufacturing process. Measuring and manufacturing the locking holes requires high precision. A straight section 16 makes it easier to restrain the ladder tube 10, 12 during the measurement and/or manufacturing of the holes and thus increases the precision obtained. The holes may for example be manufactured using punching, drilling, milling or electrical discharge machining. The straight section 16 is thus used as a technical surface during manufacturing.

Having a ladder tube having a cross-section comprising only of straight sections 16 would however not be desirable. Such a construction would be less resistant to bending and would not have a sufficient torsional stiffness. A desirable construction thus has a cross-sectional shape having at least one straight section 16 and at least one additional section which is not straight.

The present inventors have realized, after insightful consideration, that a ladder tube that has a cross-sectional shape comprising only one straight section 16 and at least one additional sections 18*a-b* being concave a better ladder tube may be provided in a novel and inventive way.

In one embodiment shown in FIG. 2*a*, the cross-sectional shape comprises a straight section 16. This straight section is a straight side which at each end is connected to one additional section 18*a*, 18*e*. The connections between the straight section 16 and the two additional sections 18*a*, 18*e* are both arranged with a connecting angle larger than 90 degrees. The connecting angle may for example be an obtuse angle, i.e. more than 90 degrees but less than 180 degrees.

The present inventors have realized, after insightful consideration, that a ladder tube that has a cross-sectional shape comprising only one straight section 16 and at least three additional sections 18*a-e*, being non-straight, a better ladder tube may be provided in a novel and inventive way. In an even more preferred embodiment, the ladder tube comprises a five additional sections 18*a*-18*e* that all have a convex shape.

In the embodiment shown in FIG. 2*a*, the cross section comprises in total six sections; a straight section 16 and five additional sections 18*a-e*. The first additional section 18*a* is connected to a first end of the straight section 16, a second additional section 18*e* is connected to a second end of the straight section 16, a third additional section 18*b* is connected to the first additional section 18*a*, a fourth additional section 18*d* is connected to the second additional section 18*e*, and a fifth additional section 18*c* interconnects the third and further additional sections 18*b*, 18*d*. The first second, third, fourth and fifth additional sections 18*a*-18*e* all have convex shapes.

Although not shown, it should be noted that the cross-sectional shape may for example also comprise a combination of two straight sections and four additional sections or three straight sections and three additional sections.

The additional concave sections 18*a* have the benefits that they provide a better resistance to bending and a higher torsional (or rotational) stiffness. When the ladder tubes are mounted in to a telescoping pipe assembly, the cross-sectional shape will allow the ladder tubes 10, 12 to retain in their position, not doing torsional movement, which makes the whole ladder construction stiff. Hence, there is no need for any additional steering parts to get the ladder tubes to only move linearly. Torsion, i.e. twisting, of the ladder tube 10, 12 is highly undesirable since the plurality of ladder tubes 10, 12 are telescopically arranged.

Furthermore, having a cross-sectional shape comprising one straight section 16 and at least one additional concave section has benefits during the assembly step during the manufacturing process. The assembly process is easier and less prone of mistake thanks to the additional sections 18 being of a different shape than the straight section 16, hence the user performing the assembly of the ladder 1 has reduced possibilities on how to assemble the ladder 1. Thus having the combination of non-straight sections 18 and a straight section 16 in the ladder tube 10, 12 has the benefits that the ladder tube 10, 12 is less likely to be mistakenly arranged in its respective rung 20.

In the embodiment shown in FIG. 2*b*, the cross-sectional shape of a ladder tube comprises a straight section 16 and one additional section 18*a*. The straight section 16 is at each end connected at an angle larger than 90 degrees to at least one additional section 18*a*. The connecting angle at each side of the straight section 16 is approximately 100-120 degrees. The additional section 18*a* is in a form of a semicircle.

FIG. 2*c* shows a top view of cross sections of several ladder tubes telescopically arranged in a collapsible ladder 1. The diameter of the cross-section of the tube being at the top, i.e. the tube arranged in the center of the tubes, is the smallest. In order for the ladder tubes to be able to be telescopically inserted into each other, the ladder tubes 10, 12 have to be at least partly hollow.

Figure 3A:
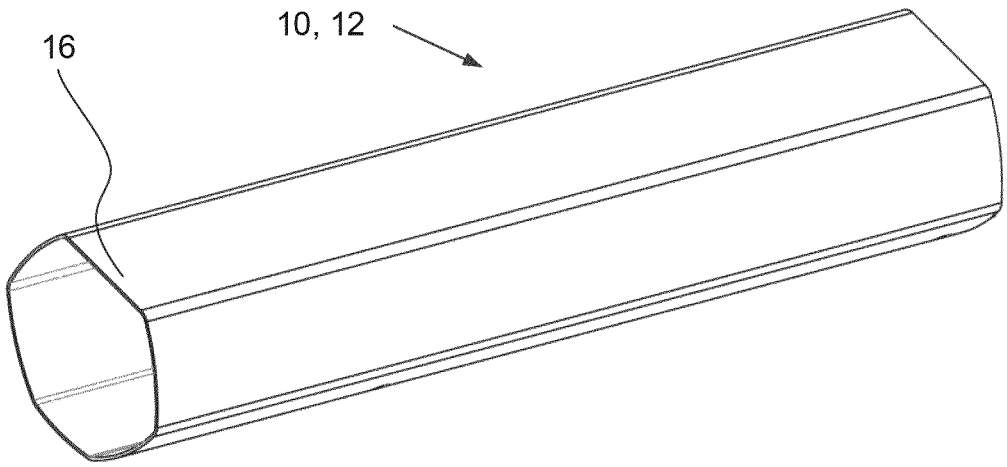
FIGS. 3*a-b* each shows an isometric view of a ladder tube according to different embodiments.

FIGS. 3*a-d* each shows an embodiment of a ladder tube 10, 12. In FIG. 3*a* a part of an exemplified embodiment of a ladder tube 10, 12 having the cross-sectional shape as discussed in relation to FIG. 2*a* is shown. The suitable length of the ladder tube 10, 12 may vary depending on national standards and the design of the ladder. The length of the ladder tube 10, 12 depends on the desired distance between the rungs. The distance between the rungs 20 may be controlled by different standards, for example the recommended distance between the rungs according to European standards is 250-300 mm.

Figure 3B:
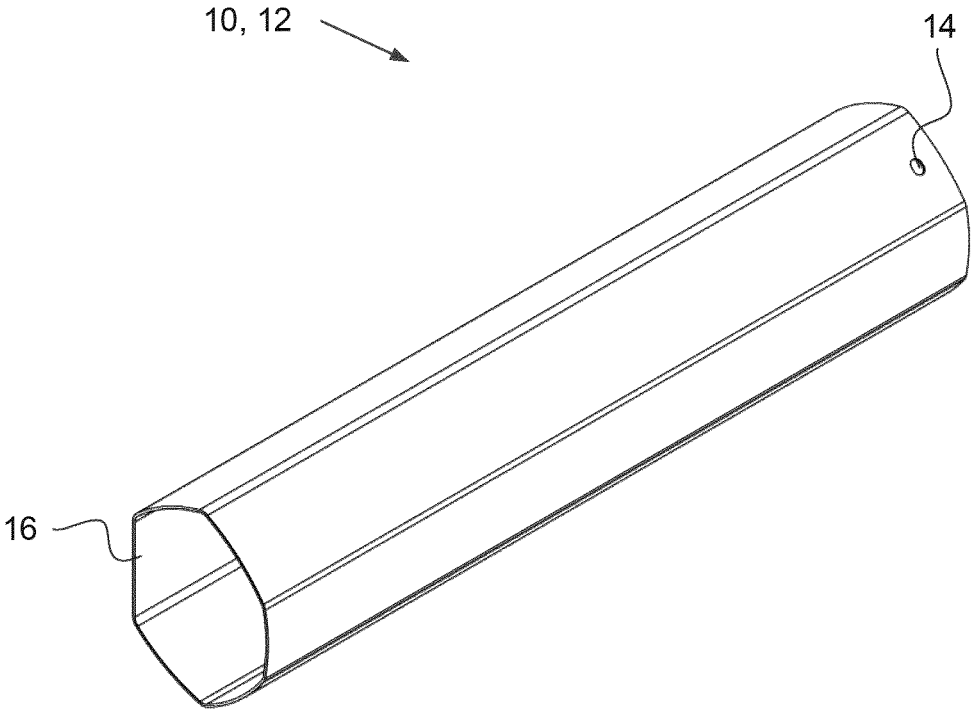

FIG. 3*b* shows an embodiment where the tube 10, 12 comprises a first mounting hole 14. The first mounting hole 14 corresponds to a rung protrusion 28 (See FIG. 4*a-e*) arranged on each bracket section 24*a*, 24*b* of the rung 20, the cooperation between the first mounting hole 14 and the rung protrusion 28 allows the rung to be securely arranged on the ladder tube 10, 12. The ladder tube 10,12 arranged at the bottom section 6 differs from the one seen in FIG. 3*b* by the arrangement of two rungs 7, 20*k*. The tube 10,12 arranged at the bottom section 6 thus comprise two first mounting holes (not shown).

Figure 3C:
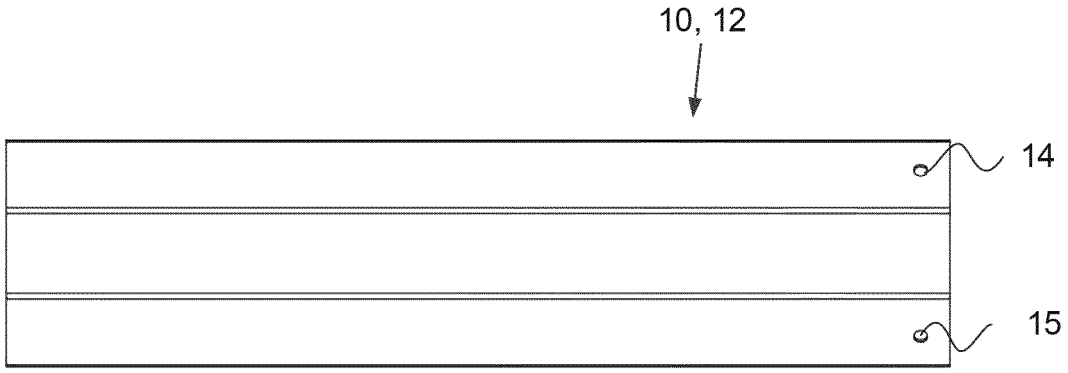
FIGS. 3*c-d* each shows a top view of a part of a ladder tube according to different embodiments.

FIG. 3*c* shows another embodiment of the ladder tube 10, 12 comprising a first mounting hole 14 and a second mounting hole 15. Each rung 20 is thus arranged with at least two rung protrusions 28 which will fixate the rung 20 to the corresponding first and second mounting holes 14, 15.

Figure 3D:
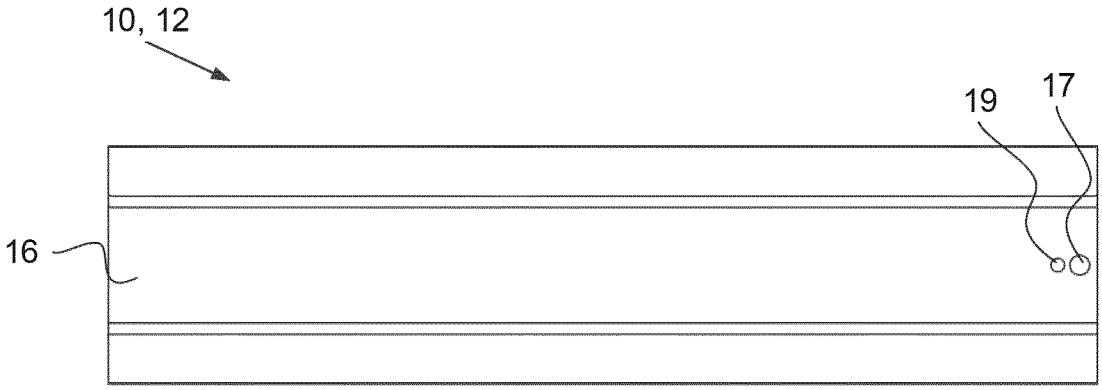

FIG. 3*d* shows an embodiment of a part of a tube 10, 12 showing the straight section 16 and two additional sections. In this embodiment the locking mechanism of the ladder comprises a locking pin 27 and a corresponding locking hole 17. The locking hole 17 is arranged on the straight section 16 of the ladder tube 10, 12. The locking hole 17 is arranged to receive the locking pin 27. The straight side 16 of the tube 10, 12 also comprises a third mounting hole 19 which together with a corresponding rung protrusion 28 helps to arrange the rung 20 to the tube 10, 12.

In one embodiment each rung 20*a* is arranged to the tube using three rung protrusions 28*a-c* which each corresponds to a first mounting hole 14, a second mounting hole 15 and a third mounting hole 19. It should be noted that the first, second and third mounting holes 14, 15, 19 may be arranged on other sections than shown herein, depending on the cross-sectional shape of the ladder tube 10, 12.

It should also be noted that the tubes 10, 12 may comprise more holes, for example fastening holes for devices preventing the ladder from being accidently pulled apart.

Figure 4A:
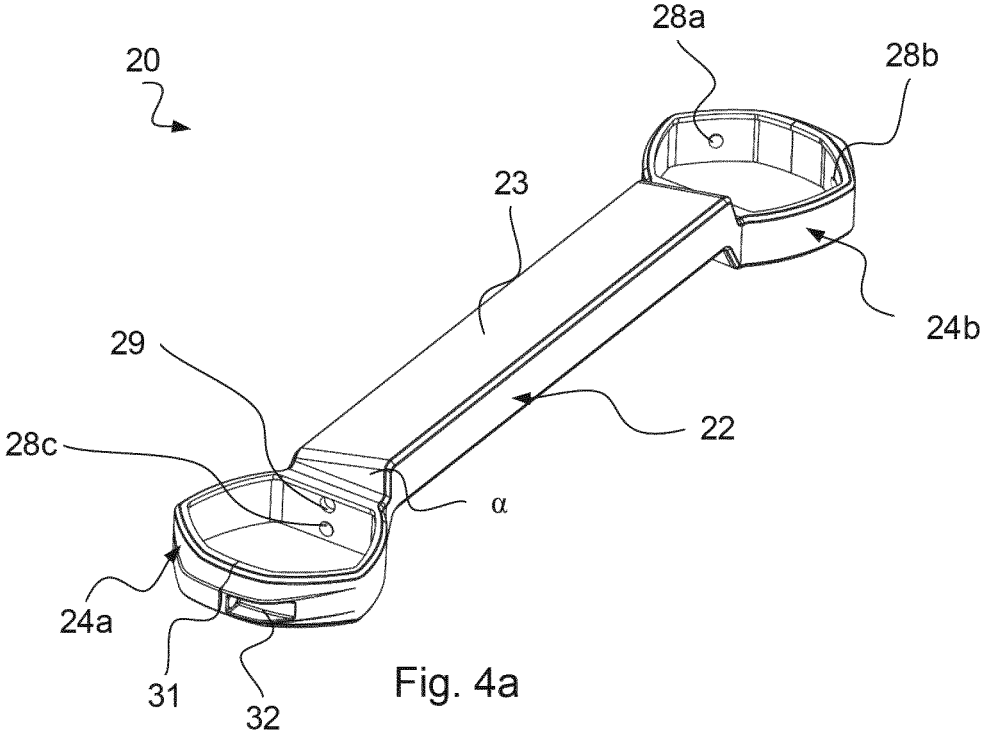
FIGS. 4*a-e* show different views of a rung according to an embodiment.
Figure 4B:
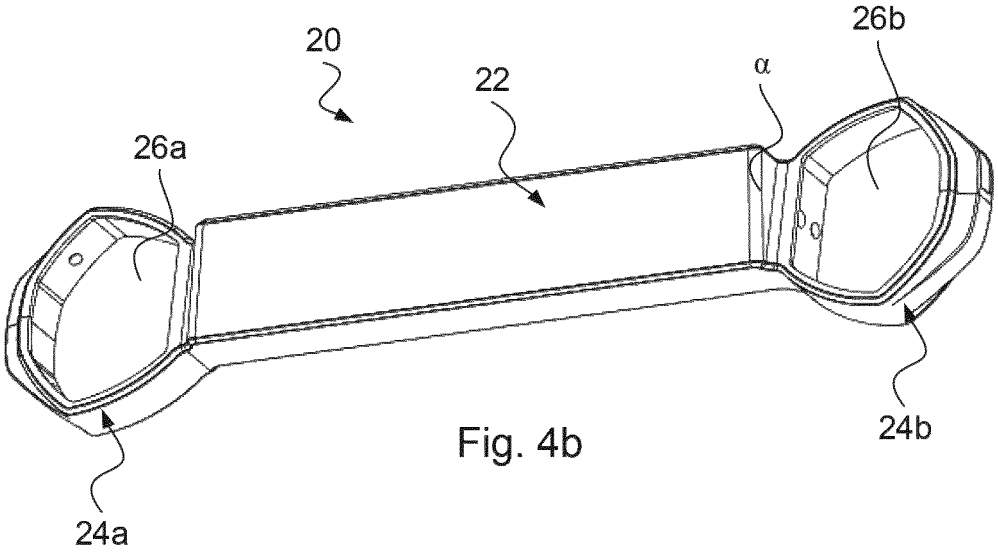
Figure 4C:
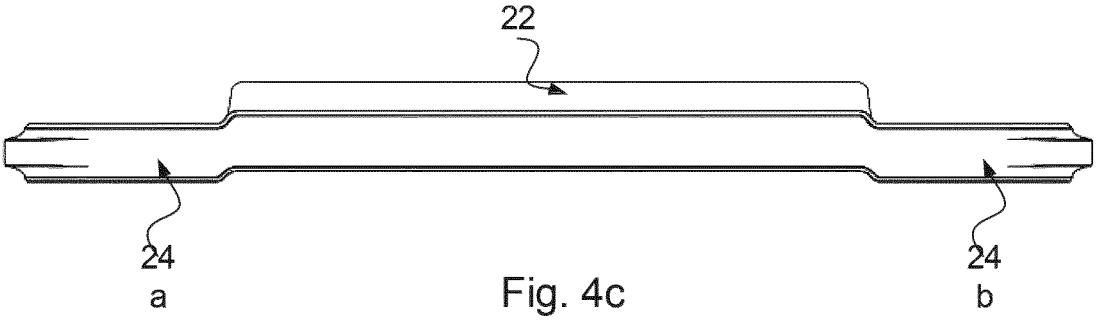

In FIG. 4*a-c* an embodiment of a rung 20 is shown in different perspective views. Each rung 20 comprises a main section 22, a first bracket section 24*a* and a second bracket section 24*b*. The first and second bracket sections 24*a-b* are arranged at each end of the rung 20 to receive the respective ladder tube 10, 12. Each bracket section 24*a-b* is arranged with an opening 26*a*, 26*b* having the same shape as the cross-sectional shape of the corresponding ladder tube 10, 12. As have been discussed in relation to FIGS. 2 and 3, the crossectional shape of the ladder tube 10, 12 may have a distinctive form. To further improve the manufacturing process, the straight section 16 of the ladder tube 10, 12 may be arranged in the bracket section so that it is facing the main section 22

The two bracket sections 24*a*, 24*b* may be identical and symmetrical to one another, i.e. the first bracket section 24*a* could be arranged on either the first or second ladder tube 10, 12.

The rung 20 is provided as a single integrated unit, where the main section 22, the first bracket section 24*a* and the second bracket section 24*b* are one single piece. The main section 22 and the first and second bracket sections 24*a-b* are formed by the same material. The material may for example be a polymer. In one embodiment the material is a thermoplastic material. The thermoplastic material may for example a polyamide, such as for example nylon. The material may be reinforced by adding compositions of glass fibers.

The feature of the rung 20 being formed as an integrated unit provides several benefits to the construction of the collapsible ladder. For example, since the new improved ladder 1 consists of fewer separate parts the assembly of the collapsible ladder is simplified. The production time is thus decreased leading to lower productions cost.

In prior art system the first and second bracket sections were attached to the main section of the rung using for example by means of press fit. This attachment step generally causes problem when performing quality tensile tests, since the parts may disconnect from each other. By providing the rung 20 as an integrated unit this problem is diminished. The durability of an integrated rung 20 is increased, especially when quality testing the ladder using tensile tests.

The main section 22 of the rung 20 is slightly inclined to provide a more user friendly ladder 1. In one embodiment, the main section 22 is inclined with an angle α with respect to a horizontal plane. The angle α may range between 10 and 20 degrees, and more preferably around 15 degrees.

The main section 22 of the rung comprises a step surface 23, which is the surface which the user is intended to place its feet during use of the ladder. In one embodiment, at least a portion of the step surface 23 of the main section 22 of the rung 20 is provided with a plurality of depressions or protrusions (not shown). The depressions or protrusions may be provided in different patterns, such as for example arranged on a plurality of lines. The individual depressions or protrusions may have the form of a circle, a cube, a line or any other suitable form. These depressions or protrusions provide a rung surface 23 which provides a better grip for the user to stand on. The risk of slipping is therefore decreased. These depressions or protrusions may be constructed in integral with the rest of the rung 20.

In one embodiment, at least a part of the step surface 23 is provided with an outer layer (not shown). The outer layer may be provided with either a plurality of depressions or protrusions arranged in different patterns and/or the outer layer may be a soft layer increasing the comfort for the user standing on the rung 20.

In one embodiment the rung 20 comprises three rung protrusions 28*a-c* arranged to fit the first, second and third mounting holes 14, 15, 19 of the ladder tube 10, 12. This secures the rung 10, 12 to the ladder tube 10, 12. The rung protrusions 28*a-c* are each arranged on the rung 20 so that it corresponds to the mounting holes 14, 15, 19 of the ladder tube 10, 12.

In order to facilitate the assembly step in the manufacturing process the rung 20 may additionally or alternatively be arranged to the ladder tube 10, 12 using clamping.

In one embodiment, the clamping function is created by having a slot or slit 31 (shown in FIG. 4*a*) arranged in the first bracket section 24*a* and the second bracket section 24*b*. During mounting of the rung 20 to the ladder tube 10, 12 the slot is arranged in a slightly open position, which allows for easier movement of the rung 20 to the ladder tube 10, 12 when arranging the rung 20 into its intend position. Once the rung 20 is in its intended position, the slot 31 is closed by locking means 32, such as a screw, that closes the slot 31 around the ladder tube 10, 12. The first bracket section 24*a* and the second bracket section 24*b* thus acts as a pipe clamp. The combination of a slit 31 and locking means 32 together with the fact that the rungs is constructed as an integrated unit, makes the rung less expensive to manufacture.

In one embodiment the rung 20 comprises a rung locking hole 29 which together with the locking hole 17 is used to receive a locking pin 27 (see FIG. 5*a-c*) used in the locking mechanism of the ladder.

Figure 4D:
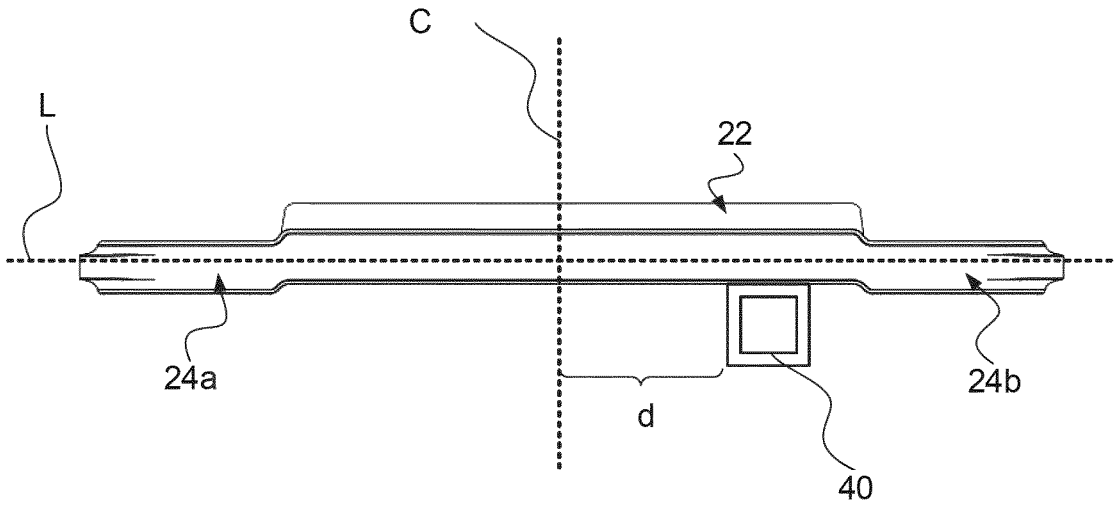
Figure 4E:
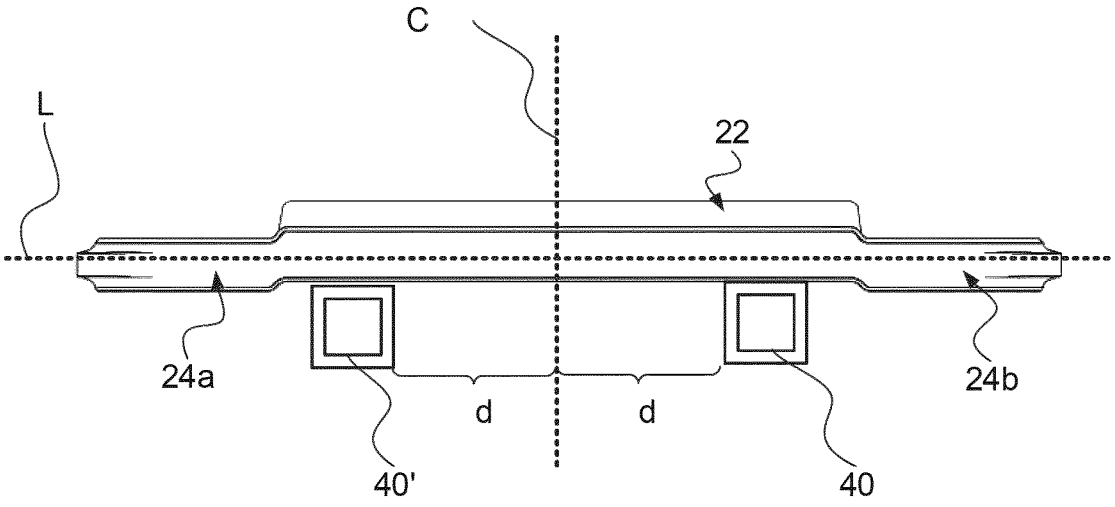

In FIG. 4*d-e* two different embodiments of a rung is shown comprising at least one grip handle 40. Having a ladder 1 where one rung 20 comprises at least one grip handle 40, 40' makes it easier for the user to carry and move around. The grip handle 40 or handles 40, 40' may be of any shape suitable to be carried, for example a rectangular handle, a rounded handle or a knob. The grip handle(s) 40, 40' may be provided on a bottom side of the rung, i.e. on the opposite side of the step surface 23.

The rung 20 shown in FIG. 4*d-e* has a central line C which is parallel with the ladder tubes 10, 12. The central line C is a vertical line arranged in the centre between the first and second bracket sections 24*a*, 24*b*. The central line C is perpendicular to a longitudinal line L which extends between the first and second bracket sections 24*a*, 24*b*.

As shown in FIG. 4*d* a single grip handle 40 is arranged at distance d from the central line C. Although the grip handle 40 is shown at the right hand side of the central line C, the grip handle 40 could also be arranged on the left hand side of the centre line.

In FIG. 4*e* a rung 20 is shown having two grip handles 40, 40'. Each grip handle is arranged at a distance d from the central line C. The distance d from the central line allows the user to carry the ladder with a beneficial angle, so as to distribute the weight of the ladder while carrying it.

Although not shown, the two grip handles 40, 40' could be arranged at different distances from the central line, for example one handle with a distance d from the central line and the other grip handle with a distance d2 from the central line, where the distance d2 could be either smaller or larger than the distance d.

In one embodiment the grip handle 40 is arranged on the bottom side of the rung as a separate unit. The grip handle and the rung are thus not constructed as a single unit.

In another embodiment the grip handle 40 is arranged in integral with the rung, and thus constructed as a single unit.

In yet another embodiment the grip handle 40 is provided on a bottom plate (not shown), where the bottom plate is removable arranged to the main section 22 of the rung 20. The bottom plate may be constructed in the same material as the rung 20.

Although not shown in the figures, it should be understood by the skilled person that the grip handle 40 may be arranged on only one or several rungs of a collapsible ladder.

The rung 20 shown in FIG. 4*a-e* does not comprise any actuators 30. This may be the case where only the second lowermost rung in ladder 1 has a pair of actuators 30 which are manually operated (such as a rotary button or a slide button) and all the other rungs are collapsed automatically by operating the actuator 30 of the second lowermost rung.

Figure 5A:
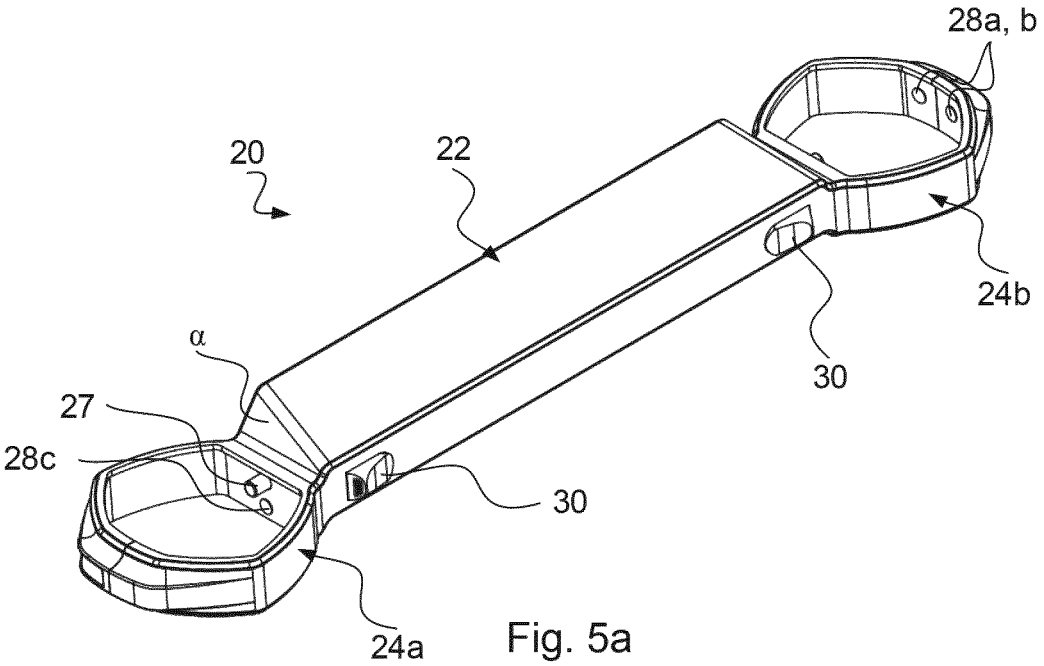
FIGS. 5*a-c* show different views of a rung according to an embodiment.
Figure 5B:
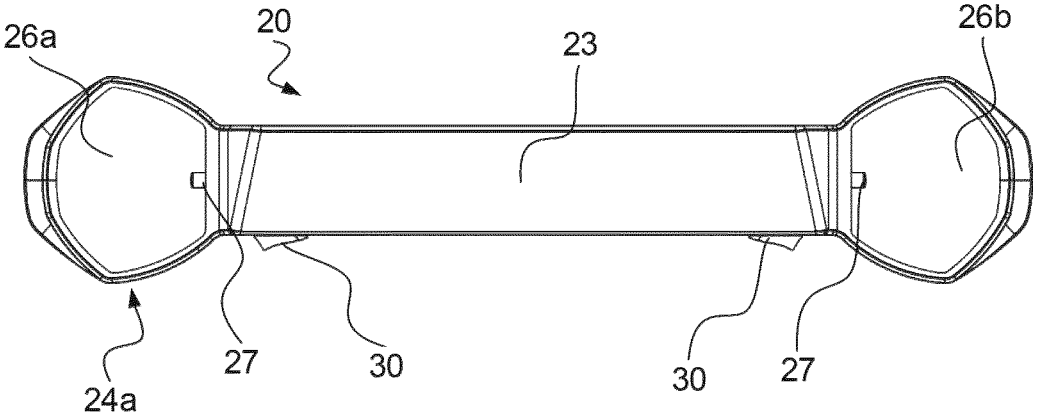
Figure 5C:
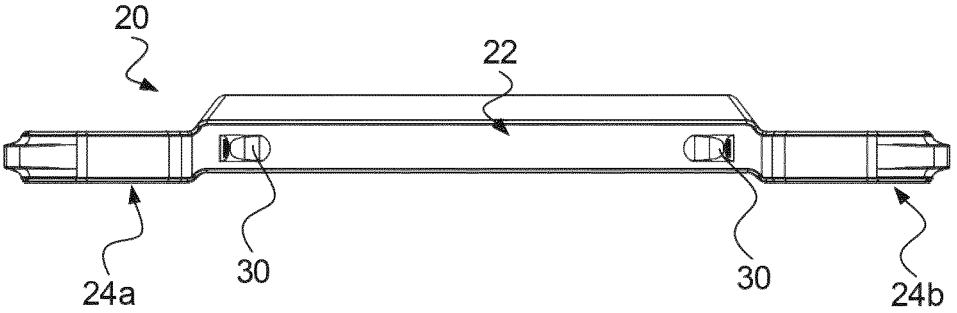

In FIG. 5*a-c* an embodiment of a rung 20 having a pair of actuators 30 is shown in different perspective views. The two actuators 30 are arranged in conjunction with the two bracket sections 24*a*, 24*b*. The spring-loaded locking pin 27 is arranged in the rung locking hole 29 of the rung 20. Here, the spring-loaded locking pin 27 is arranged on the straight section 16 of the rung 20.

In one embodiment the collapsible ladder 1 comprises locking indicators (not shown) on all or some rungs 20*a-k*. The locking indicator may have a green field to indicate that the locking mechanism associated with that locking indicator is activated and/or a red field to indicate that the locking indicator is inactivated. These indicating fields may be provided on a plate made of plastic or metal attached to the locking indicator. The locking indicator may be completely housed in the rung, but the plate with the green and red fields is visible through a recess in the rung. Alternatively the locking indicator can be arranged as colored portions of the locking pin 27.

Even though it has not been shown by the detailed embodiment or the drawings it is evident that the claimed rung can be used on a stepladder. A collapsible stepladder comprises a first and a second ladder leg. The legs are hingedly connected to each other in one end, and each of the ladder legs can be seen as an individual collapsible ladder.

It should be appreciated that even though numerous characteristics and advantages of the present invention have been set forth in the foregoing description, together with details of the structure and function of the invention, the description is only illustrative and changes may be made in detail, especially in matters of shape, size and arrangement of parts within the scope of the invention to the full extent indicated by the appended claims.

The invention claimed is:

1. A rung for use in a ladder section of a collapsible ladder that includes several ladder sections, where each ladder section has two ladder tubes arranged parallel to each other and interconnected by the rung, and where each ladder tube is telescopically inserted into a ladder tube of a lower ladder section, the rung comprising:

a main section;

a first bracket section arranged at a first end of the main section, the first bracket section configured to receive a first one of the ladder tubes; and a second bracket section arranged at a second end of the main section, the second bracket section configured to receive a second one of the ladder tubes;

wherein the main section, the first bracket section, and the second bracket section are of a unitary, one-piece construction;

wherein the main section is inclined at an angle to a plane in which the first and the second bracket sections extend; and wherein the rung is configured to be connected to each of the first and the second ladder tubes using clamping, wherein the clamping is created by a slit provided in each of the first and the second bracket sections, and a lock configured to close the slit around the first or the second ladder tube.

2. The rung according to claim 1, wherein the main section and the first and the second bracket sections are fabricated from the same material.

3. The rung according to claim 1, wherein the first and the second bracket sections are symmetrical to each other.

4. The rung according to claim 1, wherein the rung comprises at least one grip handle.

5. The rung according to claim 4, wherein the at least one grip handle is arranged at a distance from a central line of the rung;

wherein the central line is parallel with the ladder tubes; and wherein the central line is perpendicular to a longitudinal line that extends between the first and the second bracket sections.

6. The rung according to claim 4, wherein the grip handle and the rung are of a unitary, one-piece construction.

7. The rung according to claim 1, further comprising a locking mechanism.

8. The rung according to claim 7, further comprising at least one locking indicator to indicate whether the locking mechanism is in a locked position or not.

9. A collapsible ladder comprising:

several ladder sections, each ladder section including two ladder tubes arranged parallel to each other, and a rung interconnecting the two ladder tubes;

wherein each ladder tube is telescopically inserted into a ladder tube of a lower ladder section;

wherein each rung includes a main section, a first bracket section arranged at a first end of the main section, the first bracket section configured to receive a first one of the ladder tubes, and a second bracket section arranged at a second end of the main section, the second bracket section configured to receive a second one of the ladder tubes;

wherein the main section, the first bracket section, and the second bracket section of each rung are of a unitary, one-piece construction;

wherein the main section is inclined at an angle to a plane in which the first and the second bracket sections extend; and wherein the rung is configured to be connected to each of the first and the second ladder tubes using clamping, wherein the clamping is created by a slit provided in each of the first and the second bracket sections, and a lock configured to close the slit around the first or the second ladder tube.

* * * * *